US011580901B2

(12) United States Patent
Cogan et al.

(10) Patent No.: US 11,580,901 B2
(45) Date of Patent: Feb. 14, 2023

(54) AMBIENT LIGHT SENSOR

(71) Applicant: ams AG, Premstaetten (AT)

(72) Inventors: Timothy Cogan, Eindhoven (NL); Doug Nelson, Eindhoven (NL); Pradeep Hegde, Eindhoven (NL); James Archibald, Eindhoven (NL); Drew Paterson, Eindhoven (NL); George Richard Kelly, Eindhoven (NL); David Harlow Sin, Eindhoven (NL)

(73) Assignee: AMS AG, Premstaetten (AT)

( * ) Notice: Subject to any disclaimer, the term of this patent is extended or adjusted under 35 U.S.C. 154(b) by 0 days.

(21) Appl. No.: 17/283,793

(22) PCT Filed: Oct. 11, 2019

(86) PCT No.: PCT/EP2019/077577
§ 371 (c)(1),
(2) Date: Apr. 8, 2021

(87) PCT Pub. No.: WO2020/074696
PCT Pub. Date: Apr. 16, 2020

(65) Prior Publication Data

US 2021/0390903 A1 Dec. 16, 2021

Related U.S. Application Data

(60) Provisional application No. 62/744,336, filed on Oct. 11, 2018.

(51) Int. Cl.
*G09G 3/3208* (2016.01)

(52) U.S. Cl.
CPC ... *G09G 3/3208* (2013.01); *G09G 2320/0633* (2013.01); *G09G 2360/144* (2013.01); *G09G 2360/145* (2013.01); *G09G 2360/16* (2013.01)

(58) Field of Classification Search
CPC ..... G09G 2360/14; G09G 2360/144
See application file for complete search history.

(56) References Cited

U.S. PATENT DOCUMENTS

| | | | | |
|---|---|---|---|---|
| 2003/0016215 | A1* | 1/2003 | Slupe | G09G 5/18 345/213 |
| 2006/0092182 | A1* | 5/2006 | Diefenbaugh | G09G 5/00 345/207 |
| 2014/0166850 | A1 | 6/2014 | Zheng | |
| 2014/0183342 | A1 | 7/2014 | Shedletsky et al. | |
| 2017/0092187 | A1 | 3/2017 | Bergquist | |

* cited by examiner

*Primary Examiner* — Kevin M Nguyen
(74) *Attorney, Agent, or Firm* — Tarolli, Sundheim, Covell & Tummino LLP

(57) ABSTRACT

Techniques are described for portable computing devices and other apparatus that include an ambient light sensor. The techniques can be particularly advantageous for situations in which the ambient light sensor is disposed behind a display screen of a host device such that ambient light detected by the sensor passes through the light emitting display before being detected by the sensor.

19 Claims, 3 Drawing Sheets

AMBIENT LIGHT SENSOR

RELATED APPLICATIONS

The present invention is a U.S. National Stage under 35 USC 371 patent application, claiming priority to Serial No. PCT/EP2019/077577, filed on 11 Oct. 2019; which claims priority of U.S. Provisional Application No. 62/744,336, filed on 11 Oct. 2018, the entirety of both of which are incorporated herein by reference.

FIELD OF THE DISCLOSURE

This disclosure relates to ambient light sensors.

BACKGROUND

A recent trend in smartphone industrial design is to maximize the screen area by reducing the bezel width and decluttering the remaining bezel area by removing apertures for optical sensors and other holes for microphones, speakers and/or fingerprint reading devices. On the other hand, there also is a trend to increase the number of optical sensors for added functionality. For example, ambient light sensors (ALSs) can be provided to facilitate adjustment of the display screen brightness to the surrounding lighting environment so as to make the display appear sharp and readable while also reducing the display's overall energy consumption.

A further trend in the smartphone market is the adoption of organic light emitting displays (OLEDs). This trend creates an opportunity to move the ALS from the smartphone's bezel to a position under the OLED OLEDs are generally opaque primarily as a result of a protective film on their backside. This film can be removed in a very small area to allow ambient light to pass through the remaining layers of the OLED to reach the ALS. However, even with the film removed, the OLED is not very optically transmissive, thus requiring a very sensitive sensor to make ambient light detection possible. There is a further complication which makes ambient light detection through an OLED technically challenging. An ALS sensor will detect not only ambient light (e.g., background light, sunlight, etc.) passing through the display, but will also detect the light generated by the display itself. As a result, the display brightness, as driven by the ALS, will fluctuate with changes in the brightness of the pixels directly above the sensor. Such fluctuations are undesirable.

SUMMARY

This disclosure describes portable computing devices and other apparatus that include an ambient light sensor. The techniques described in this disclosure can be particularly advantageous for situations in which the ambient light sensor is disposed behind a display screen of a host device such that ambient light detected by the sensor passes through the light emitting display before being detected by the sensor.

For example, in one aspect, an apparatus includes a light emitting display screen, an ambient light sensor disposed behind the display screen, and a processor operable to receive, process and analyze signals from the ambient light sensor and to control a brightness of the display screen. The processor also is operable to estimate a first amount of a light signal detected by the ambient light sensor that is attributable to light generated by the display screen, and to subtract the first amount from a second amount so as to obtain an ambient light value, wherein the second amount represents a combined amount of light detected by the ambient light sensor, the combined amount including ambient light and light generated by the display screen. The processor is operable to control the brightness of the display screen based, at least in part, on the ambient light value.

Some implementations include one or more of the following features. For example, the display screen can be an OLED-type display screen. The apparatus also can include a cover glass, wherein the light emitting display screen is disposed behind the cover glass.

In some instances, the processor is operable to estimate the first amount of the light signal detected by the ambient light sensor based on a feature of a signal detected by the ambient light sensor, wherein the feature correlates with an amplitude of a light signal generated by the display screen. The feature of the signal detected by the ambient light sensor that correlates with the amplitude of the light signal generated by the display screen can correspond, for example, to a refresh period of the display screen. In some implementations, the processor is operable to extract a periodic signal from data received from the ambient light sensor, wherein an amplitude of the extracted periodic signal correlates with an amplitude of the light generated by the display screen. The processor also can be operable to access a look-up table to estimate the amplitude of the light generated by the display screen based on the amplitude of the extracted periodic signal. In some cases, the periodic signal has a period that is the same as a period of a refresh signal for the display screen.

In some instances, the ambient light sensor includes multiple light channels, and the processor is operable to control the brightness of the display screen based, at least in part, on a weighted average of the respective ambient light values for the channels. The processor can be operable, in some cases, to report a lux value to the display screen, wherein the lux value is based at least in part on the ambient light value. The display screen can be operable to respond in a predetermined manner based on the reported lux value. For example, in some implementations, the display screen is operable to adjust its display light level in response to the reported lux value.

In another aspect, the present disclosure describes a method of controlling a brightness of a display screen. The method includes detecting, in an ambient light sensor disposed behind the light emitting display, a combined amount of light including ambient light and light generated by the display screen. The method includes receiving, in a processor, signals from the ambient light sensor, wherein the received signals represent the combined amount of light. The method further includes estimating, by the processor, a first amount of a light signal detected by the ambient light sensor that is attributable to light generated by the display screen, and subtracting the first amount from a second amount so as to obtain an ambient light value, wherein the second amount represents the combined amount of light. The brightness of the display screen can be adjusted based, at least in part, on the ambient light value.

In some instances, operation of the display screen (or other sub-system whose operation is adjusted based on the ambient light level) can be improved by incorporating the techniques described in this disclosure. Such improvements can, in turn, improve the overall operation of the host device.

Other aspects, features and advantages will be readily apparent from the following detailed description, the accompanying drawings and the claims.

DETAILED DESCRIPTION

Figure 1:
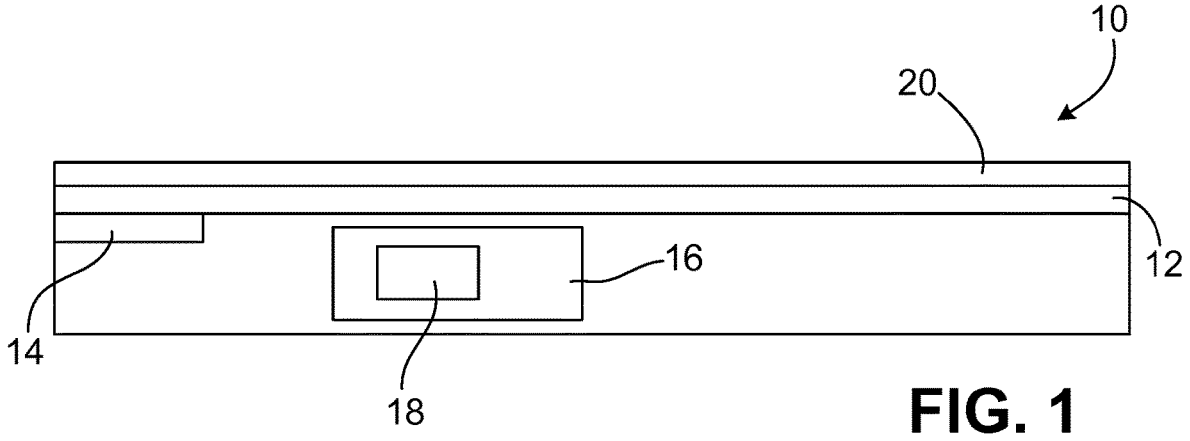
FIG. 1 illustrates various features of a host device that includes an ambient light sensor behind a display screen.

As shown in FIG. 1, a host device 10 such as a portable computing device (e.g., a smartphone, personal digital assistant (PDA), laptop or wearable) includes an OLED-type or other display screen 12, which can be disposed directly under a front glass 20. An ambient light sensor (ALS) 14 is disposed directly under a portion of the display screen 12 and is operable to sense ambient light (e.g., sunlight or other background light). The ALS 14 also may sense light generated by the display screen 12 itself. The ALS 14 can comprise one or more photodiodes or other light sensing elements, each of which is sensitive to a respective wavelength, or range of wavelengths, that may differ from one another. A processor (e.g., circuitry and/or software) 16 is operable to receive, process and analyze signals from the ALS 14 and to control brightness of the display screen 12. The processor 16 can be, for example, a processor for the sensor hub or some other processor in the portable computing device 10.

Figure 2:
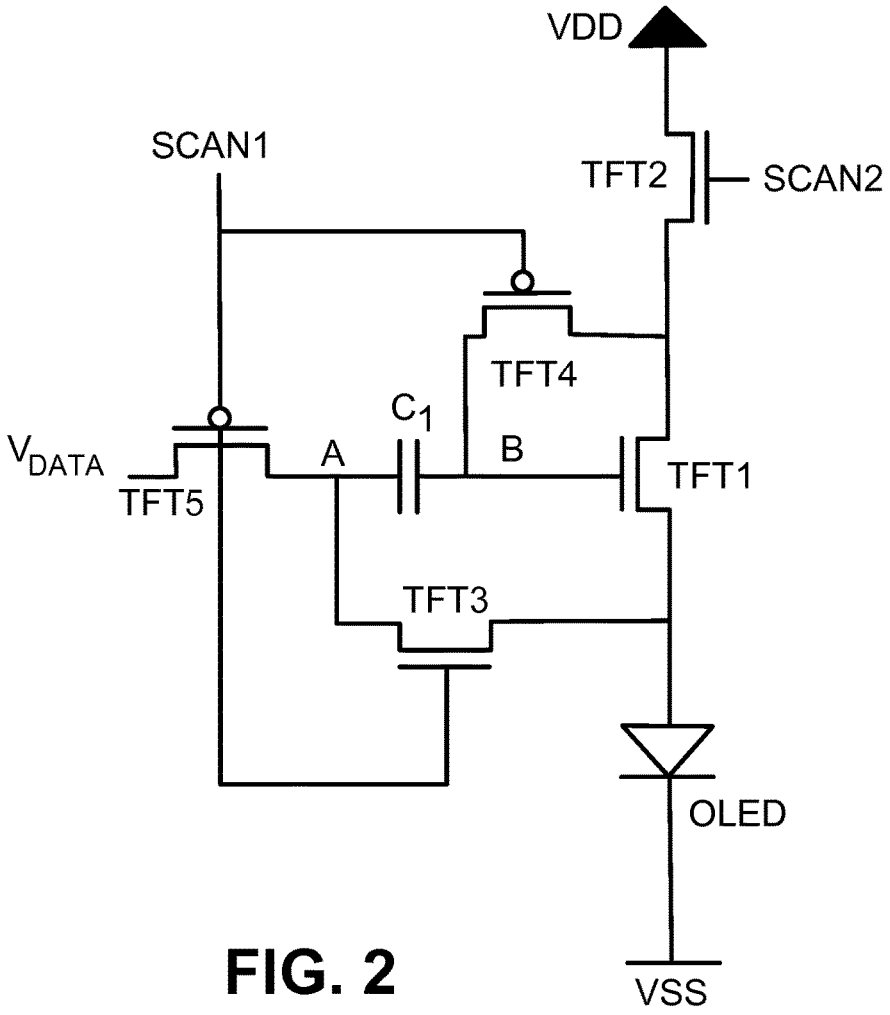
FIG. 2 shows an example of a drive circuit for an organic light emitting display.

Overall brightness of the OLED can be controlled, for example, by either applying PWM modulation of each pixel with a transistor in series with the pixel or by the adjusting the overall range of current that can drive each pixel. FIG. 2 shows an example of an OLED drive circuit for a single OLED pixel. The current that drives each pixel, and therefore the brightness of each pixel, is controlled by a first transistor TFT1 depending on the charge stored on the capacitor C1. Before each pixel is turned on, the capacitor C1 is charged to the appropriate level, $V_{DATA}$, by setting the voltage SCAN1 to low. Once the voltage SCAN2 becomes high, a second transistor TFT2 turns on and allows current to flow through the OLED pixel as modulated by the first transistor TFT1. The voltage SCAN2 also is used to apply the PWM modulation to reduce the overall display brightness by applying a square waveform at a multiple of the periodic display frame rate (e.g., a multiple of 60 Hz). The duty cycle of the square wave sets the display brightness.

The inventors of the present application determined that the amplitude of an artifact that appears in the signal sensed by the ALS 14 correlates generally with the amplitude of the light signal generated by the OLED 12 itself. The artifact results from the display's refresh period (sometimes referred to as the display blanking period) and can be used to estimate the amplitude of the light signal from the OLED 12. The estimated OLED light signal then can be subtracted from the corresponding signal sensed by the ALS 14 to obtain a more accurate estimate of the ambient light signal.

Figure 3:
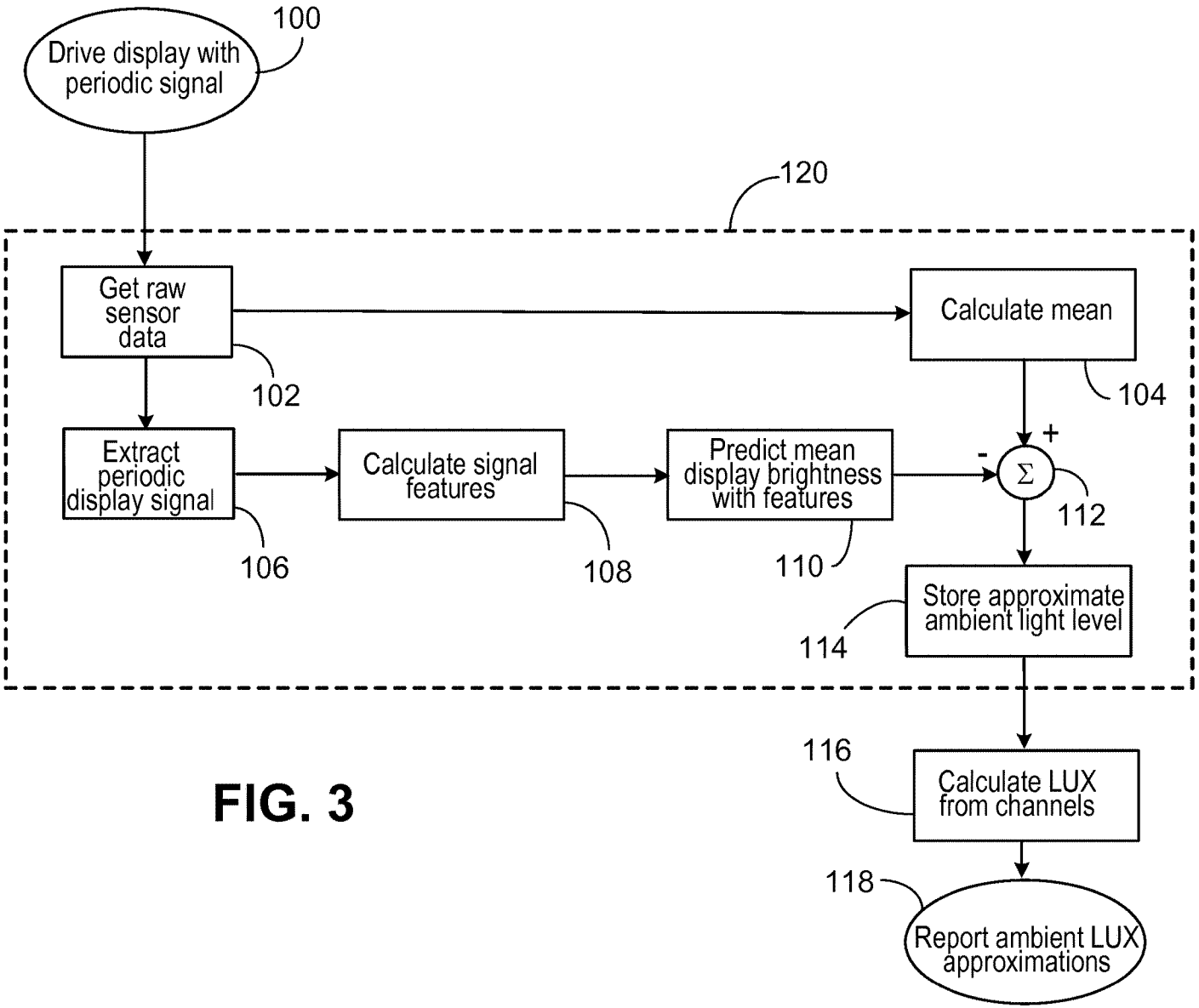
FIG. 3 is a flow chart showing an example of a method according to the present disclosure.

FIG. 3 is a flow chart showing further details according to some implementations. As indicated at 100, the display 12 is driven by a periodic (e.g., 60 Hz) drive signal. The sensor 14 detects light signals while the display is being operated and generates raw data based on the detected signals. As indicated by 102, the processor 16 obtains the raw data from the sensor 14. As indicated at 104, using the raw data obtained from the sensor 14, the processor 16 calculates the average (e.g., mean) value of the sensor data over a specified duration (e.g., 100 msec). The average value is based on ambient light signals detected by the sensor 14, as well as any light signals generated by the display 12 that are detected by the sensor 14. Thus, the average value calculated by the processor 16 represents the average of the combined ambient light signal and the display light signal.

Figure 4A:
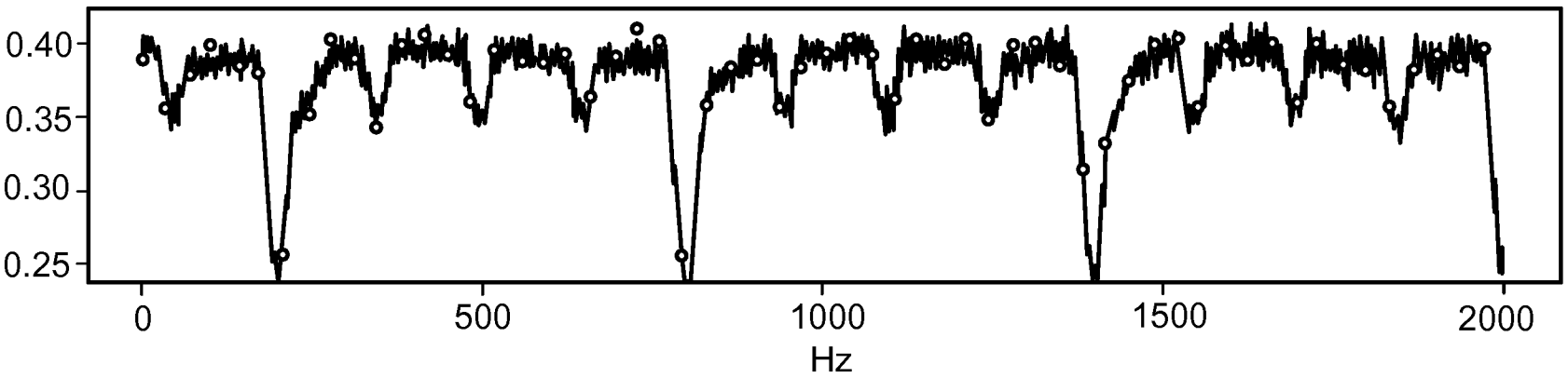
FIG. 4A illustrates an example of a simulated display blanking waveform
Figure 4B:
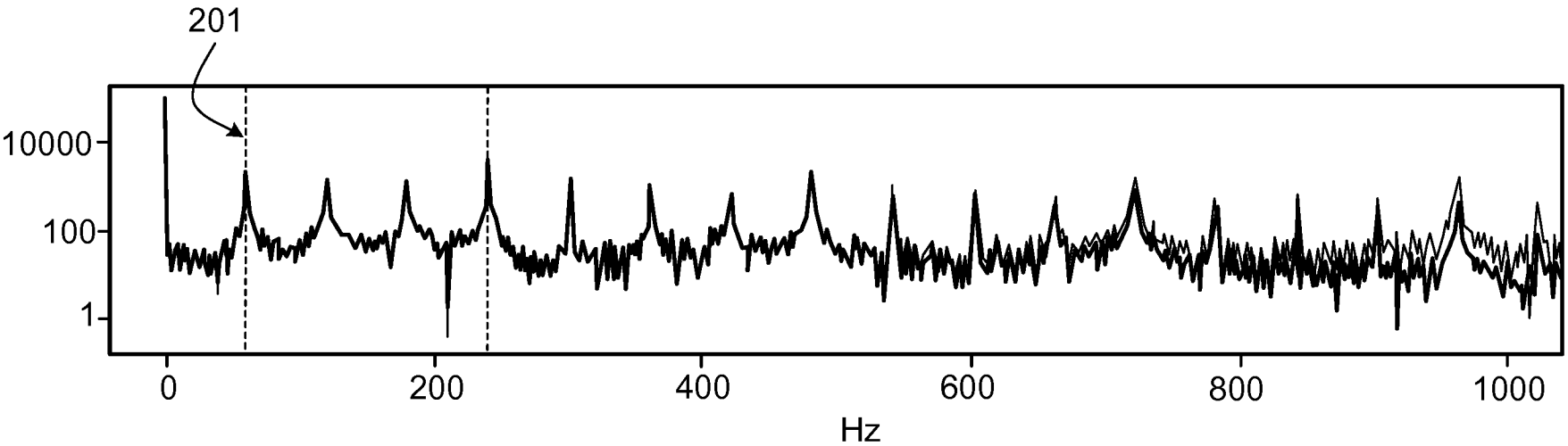
FIG. 4B illustrates the amplitudes resulting from a frequency analysis of the waveform of FIG. 4A.

As indicated at 106, the processor 16 also extracts the periodic display signal from the raw sensor data. Further, as indicated at 108, the processor 16 calculates one or more signal features (e.g., amplitude) of the extracted periodic signal. FIG. 4A illustrates an example of display blanking waveform having a frequency of 60 Hz and showing a negative peak every 1/60 second. FIG. 4B illustrates the amplitudes resulting from a frequency analysis for the range of 0 Hz to about 1000 Hz. The vertical dotted line 201 in FIG. 4B identifies the 60 Hz signal. The amplitude of the 60 Hz signal (i.e., the amplitude of the portion of the sensor signal corresponding to the display refresh period) can thus be determined and is assumed to correlate to the amplitude of the display light signal.

As indicated by 110, the processor 16 estimates the average (e.g., mean) sensed display brightness based on the amplitude of the 60 Hz signal previously identified in operation 108. For this purpose, the processor 16 can access a look-up table (LUT) 18 stored in memory or implemented in software (see FIG. 1). The LUT 18 stores a correlation between the amplitude of the 60 Hz signal (i.e., the amplitude of the portion of the sensor signal corresponding to the display refresh period) and a value of the display brightness (i.e., in the absence of other ambient light). The data in the LUT 18 can be obtained and stored, for example, during factory calibration. In some cases, the LUT data is obtained by operating the display 12 and ALS 14 in an otherwise dark environment so as to determine a correlation between the amplitude of the 60 Hz artifact in the signal detected by the ALS 14 and the light signal generated by the display 12.

At 112, the processor 16 then calculates the difference between the average (e.g., mean) value of the sensor data obtained at operation 104 and the average (e.g., mean) sensed display brightness determined at operation 110. The difference represents an estimate of the ambient light signal. The resulting estimate of the ambient light signal can be stored in memory associated with the processor 16.

As mentioned above, in some implementations, the ALS 14 includes multiple channels (e.g., multiple photodiodes each of which is sensitive to a different respective wavelength or range of wavelengths). In such instances, the processor 16 can perform the operations within the dashed box 120 (i.e., operations 102 through 114) for each channel, respectively. As indicated at 116, the processor 16 then calculates the ambient lux (i.e., the illuminance) based on the ambient light level(s) stored at 114. Where the ALS 14 has multiple channels, the processor 16 can calculate the lux based, for example, on a weighted average of the estimated ambient light values for the various channels. For example, in some implementations (e.g., a 4-channel implementation), the lux calculation is a linear combination of the channels, e.g., lux=(channel_0*a)+(channel_1*b)+(channel_2*c)+(channel_3*d), where the values of a, b, c and d depend on the OLED glass transmissivity, the spectral responses of the channels, and in some cases the light type being measured. The values of a, b, c and d can be determined, for example, empirically.

As indicated at 118, the resulting ambient lux value then can be reported by the processor 16, for example, to a sub-system of the portable computing device 10 that responds in some predetermined manner based on the report information. For example, in some implementations, the resulting ambient lux value is used to control the display light level. In particular, the display screen 12 can be operable to adjust its display light level in response to receiving the reported lux value from the processor 16.

The techniques described here can be used to compensate for display brightness so that an ambient light sensor 14 can be used to measure ambient light levels even when disposed behind the display 12.

Although a 60 Hz signal is used in the particular examples described above, other frequencies can be used for other implementations.

Various aspects of the subject matter and the functional operations described in this specification can be implemented in digital electronic circuitry, or in computer software, firmware, or hardware, including the structures disclosed in this specification and their structural equivalents, or in combinations of one or more of them. Thus, aspects of the subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The apparatus can include, in addition to hardware, code that creates an execution environment for the computer program in question, e.g., code that constitutes processor firmware.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, various modifications may be made without departing from the spirit and scope of the invention. Accordingly, other implementations are within the scope of the invention.

The invention claimed is:

1. An apparatus comprising:

a light emitting display screen;

an ambient light sensor disposed behind the display screen; and a processor configured to receive, process and analyze signals from the ambient light sensor and to control a brightness of the display screen, wherein the processor is configured to estimate a first amount of a light signal detected by the ambient light sensor that is attributable to light generated by the display screen, to subtract the first amount from a second amount so as to obtain an ambient light value, wherein the second amount represents a combined amount of light detected by the ambient light sensor, the combined amount including ambient light and light generated by the display screen, and wherein the processor is configured to control the brightness of the display screen based, at least in part, on the ambient light value.

2. The apparatus of claim 1, wherein the display screen comprises an OLED-type display screen.

3. The apparatus of claim 1, wherein the processor is configured to estimate the first amount of the light signal detected by the ambient light sensor based on a feature of a signal detected by the ambient light sensor, wherein the feature correlates with an amplitude of a light signal generated by the display screen.

4. The apparatus of claim 3, wherein the feature of the signal detected by the ambient light sensor that correlates with the amplitude of the light signal generated by the display screen corresponds to a refresh period of the display screen.

5. The apparatus of claim 1, wherein the processor is configured to extract a periodic signal from data received from the ambient light sensor, wherein an amplitude of the extracted periodic signal correlates with an amplitude of the light generated by the display screen, the processor further being configured to access a look-up table to estimate the amplitude of the light generated by the display screen based on the amplitude of the extracted periodic signal.

6. The apparatus of claim 5, wherein the periodic signal has a period that is the same as a period of a refresh signal for the display screen.

7. The apparatus of claim 1 further comprising a cover glass, wherein the light emitting display screen is disposed behind the cover glass.

8. The apparatus of claim 1 wherein the ambient light sensor includes multiple light channels, the processor being configured to estimate, for each particular channel separately, a respective ambient light value by:

estimating a first respective amount of a light signal detected by the particular channel that is attributable to light generated by the display screen; and subtracting the first respective amount from a second respective amount so as to obtain the respective ambient light value, wherein the second amount represents a combined amount of light detected by the particular channel, the combined amount including ambient light and light generated by the display screen, wherein the processor is configured to control the brightness of the display screen based, at least in part, on a weighted average of the respective ambient light values for the channels.

9. The apparatus of claim 1, wherein the processor is configured to report a lux value to the display screen, wherein the lux value is based at least in part on the ambient light value, the display screen being configured to respond in a predetermined manner based on the reported lux value.

10. The apparatus of claim 9, wherein the display screen is configured to adjust its display light level in response to the reported lux value.

11. A method of controlling a brightness of a display screen, the method comprising:

detecting, in an ambient light sensor disposed behind the light emitting display, a combined amount of light including ambient light and light generated by the display screen, receiving, in a processor, signals from the ambient light sensor, the received signals representing the combined amount of light;

estimating, by the processor, a first amount of a light signal detected by the ambient light sensor that is attributable to light generated by the display screen;

subtracting the first amount from a second amount so as to obtain an ambient light value, wherein the second amount represents the combined amount of light; and adjusting the brightness of the display screen based, at least in part, on the ambient light value.

12. The method of claim 11, wherein the display screen comprises an OLED-type display screen.

13. The method of claim 11, wherein the estimating the first amount of the light signal detected by the ambient light sensor is based on a feature of a signal detected by the ambient light sensor, wherein the feature correlates with an amplitude of a light signal generated by the display screen.

14. The method of claim 13, wherein the feature of the signal detected by the ambient light sensor that correlates with the amplitude of the light signal generated by the display screen corresponds to a refresh period of the display screen.

15. The method of claim 11, further comprising extracting a periodic signal from data received from the ambient light sensor, wherein an amplitude of the extracted periodic signal correlates with an amplitude of the light generated by the display screen, the method further including accessing a look-up table to estimate the amplitude of the light generated by the display screen based on the amplitude of the extracted periodic signal.

16. The method of claim 15, wherein the periodic signal has a period that is the same as a period of a refresh signal for the display screen.

17. The method of claim 11, wherein the ambient light sensor includes multiple light channels, the method including estimating, for each particular channel separately, a respective ambient light value by:

estimating a first respective amount of a light signal detected by the particular channel that is attributable to light generated by the display screen; and subtracting the first respective amount from a second respective amount so as to obtain the respective ambient light value, wherein the second amount represents a combined amount of light detected by the particular channel, the combined amount including ambient light and light generated by the display screen; and controlling the brightness of the display screen based, at least in part, on a weighted average of the respective ambient light values for the channels.

18. The method of claim 11 including:

reporting a lux value that is based at least in part on the ambient light value; and adjusting the light level of the display screen in response to the reported lux value.

19. The method of claim 11, wherein the ambient light passes through the light emitting display before being detected by the ambient light sensor.

* * * * *